US007407465B1

(12) United States Patent
Alzamora, Sr. et al.

(10) Patent No.: US 7,407,465 B1
(45) Date of Patent: Aug. 5, 2008

(54) TORSO EXERCISING APPARATUS

(76) Inventors: David Alzamora, Sr., 1808 52nd St. South West, Naples, FL (US) 34116; Gerardo Alzamora, Jr., 1808 52nd St. South West, Naples, FL (US) 34116

( * ) Notice: Subject to any disclaimer, the term of this patent is extended or adjusted under 35 U.S.C. 154(b) by 641 days.

(21) Appl. No.: 10/898,732

(22) Filed: Jul. 26, 2004

(51) Int. Cl.
*A63B 22/00* (2006.01)

(52) U.S. Cl. ..... 482/51; 482/132; 280/205

(58) Field of Classification Search ..... 482/51, 482/68, 131, 132; 280/29, 87.01, 87.021, 280/288.4, 293, 301, 205; 446/448
See application file for complete search history.

(56) References Cited

U.S. PATENT DOCUMENTS 1,916,660 A * 7/1933 Duff ..... 482/110
1,997,139 A * 4/1935 Gardener et al. ..... 482/132
2,069,384 A * 2/1937 Ogden ..... 482/132
3,784,192 A 1/1974 Nutter
3,895,795 A * 7/1975 Merz ..... 482/8
4,029,329 A * 6/1977 Chambers ..... 280/87.021
4,126,308 A * 11/1978 Crumley ..... 482/25
4,595,197 A * 6/1986 Hagstrom et al. ..... 482/132
4,826,151 A * 5/1989 Nuredin ..... 482/68
5,004,229 A * 4/1991 Lind ..... 482/132
5,054,803 A * 10/1991 Ellingsen, Jr. ..... 280/301
5,176,595 A * 1/1993 Lind ..... 482/51
5,447,483 A 9/1995 Liang
6,053,853 A * 4/2000 Hinds ..... 482/132
D446,264 S 8/2001 Fischer et al.
6,575,883 B1 * 6/2003 Hinds ..... 482/132
6,805,657 B2 * 10/2004 Trenary ..... 482/51

* cited by examiner

*Primary Examiner*—Jerome Donnelly
*Assistant Examiner*—Tam Nguyen

(57) ABSTRACT

A portable exercising apparatus for isolating a user's torso muscles during operating conditions includes at least one wheel section that has at least one rim including a plurality of spokes, an elongated axle, and at least one hub including a bearing disposed therein. The apparatus further includes a mechanism for supporting a user's feet at an elevated position and along a substantially horizontal plane. Such a supporting mechanism is secured to the axle and is disposed adjacent the at least one wheel section to thereby allow a user to perform exercise movements while extended along a generally horizontal plane. The present invention may reside in alternate embodiments wherein various wheel sections cooperate with the supporting mechanism for providing an effective exercising apparatus.

4 Claims, 5 Drawing Sheets

TORSO EXERCISING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to an exercising apparatus and, more particularly, to a torso exercising apparatus to increase torso strength and physical endurance.

2. Prior Art

It is well known that having suitable exercises daily is helpful to the health. Adequate exercising amount is important to people working in offices. Various exercising apparatus, including rowing machines, step machines, chest developers, etc., have been disclosed for indoor exercises, and have appeared on the market. These exercising apparatus are commonly designed for exercising specific parts of the body and are generally stationary, space consuming apparatus. Few exercising apparatus provide the function of exercising the whole body.

Further more, many portable exercise devices are effective to tone up specific muscle groups of the body; but few, if any, are effective to tone up many or most muscle groups. By contrast, many stationary exercise devices are effective to tone up many muscle groups of the body; but these devices typically are big and costly. Moreover, such stationary devices have many separate stations each directed to tone certain groups only, so that to achieve toning of many muscle groups, the exerciser must exercise at many of the different stations.

Also, most such devices use pneumatics, springs or weights to provide resistance for the exerciser to move throughout specific motions. This means that physical components of different sizes and/or capacities would be needed to impose different resistances suited for different exercisers, in part depending on the size and strength of each exerciser. The needed inventory of such physical components may increase the costs and reduce the appeal, overall, of such an exercise device.

Accordingly, a need remains for a complete torso exercising apparatus to over-come that above-noted shortcomings.

BRIEF SUMMARY OF THE INVENTION

In view of the foregoing background, it is therefore an object of the present invention to provide a torso exercising apparatus to increase torso strength and physical endurance. These and other objects, features, and advantages of the invention are provided by a portable exercising apparatus for isolating a user's torso muscles during operating conditions.

The apparatus includes at least one wheel section including at least one rim that has a plurality of spokes diametrically extending between a circumference thereof. The apparatus further includes an elongated axle secured to a substantially central portion of at least one rim, and at least one hub including a bearing disposed therein for cooperating with the at least one rim so that at least one wheel section can be rotated along a select surface.

The present invention also includes a mechanism for supporting a user's feet at an elevated position and along a substantially horizontal plane. The supporting mechanism may be secured to the axle and is disposed adjacent to the at least one wheel section to thereby allow a user to effectively perform exercise movements while extended along a generally horizontal plane. In select embodiments, the plurality of pads may have a concave top surface formed from resilient material for providing user comfort during exercising conditions.

In a preferred embodiment, the apparatus preferably includes a plurality of elongated leg members that have opposed end portions pivotally connected to the hub and engageable with a ground surface. The plurality of leg members are movable between lowered and raised positions along a predetermined arcuate path for advantageously providing lateral support and assisting a user to maintain a substantially stable position during exercising conditions. In such an embodiment, the plurality of pads are secured to the axle at opposite sides of the at least one wheel section.

In an alternate embodiment, first and second spaced wheel sections are disposed adjacent opposed end portions of the axle and a supporting mechanism is preferably positioned substantially medially of the first and second wheel sections.

In yet another embodiment, a third wheel section is spaced forwardly from the first and second wheel sections for providing additional support during operating conditions. Such an embodiment preferably further includes an elongated support member having a forked end portion secured to the third wheel section for advantageously maintaining the supporting mechanism spaced above the axle.

In yet another embodiment, the first, second and third wheel sections are equally spaced along a length of the axle. The supporting mechanism preferably includes a plurality of pads juxtaposed between the first, second and third wheel sections so that a user's feet can be disposed at opposed sides of the second wheel section respectively.

In yet another embodiment, the at least one wheel section may be secured subjacent to opposed corners of the supporting mechanism. The axle extends upwardly from select ones of the at least one wheel section and is telescopically adjustable along a substantially vertical plane for effectively raising and lowering a height of the supporting mechanism along an arcuate path, as desired by a user.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
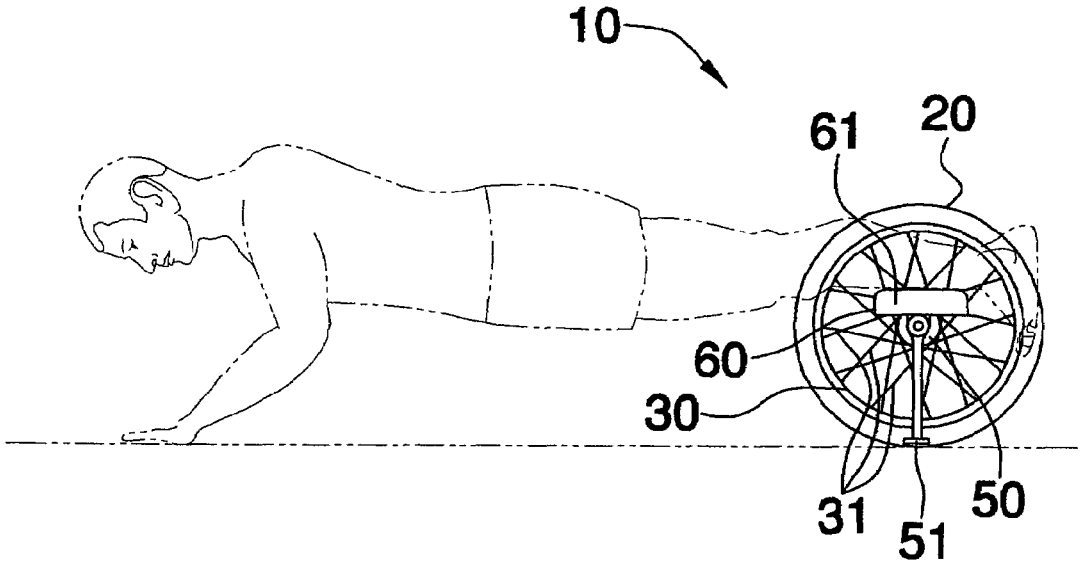
FIG. 1 is a side elevational view showing a preferred embodiment of a torso exercising apparatus, in accordance with the present invention.
Figure 2:
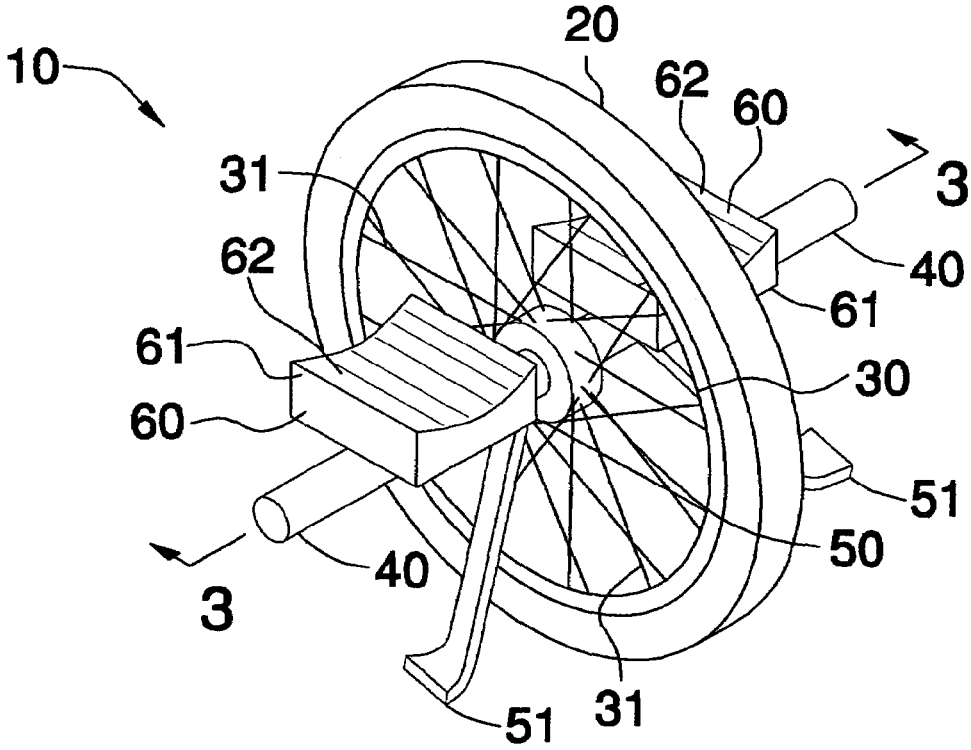
FIG. 2 is an enlarged perspective view of the apparatus shown in FIG. 1.
Figure 3:
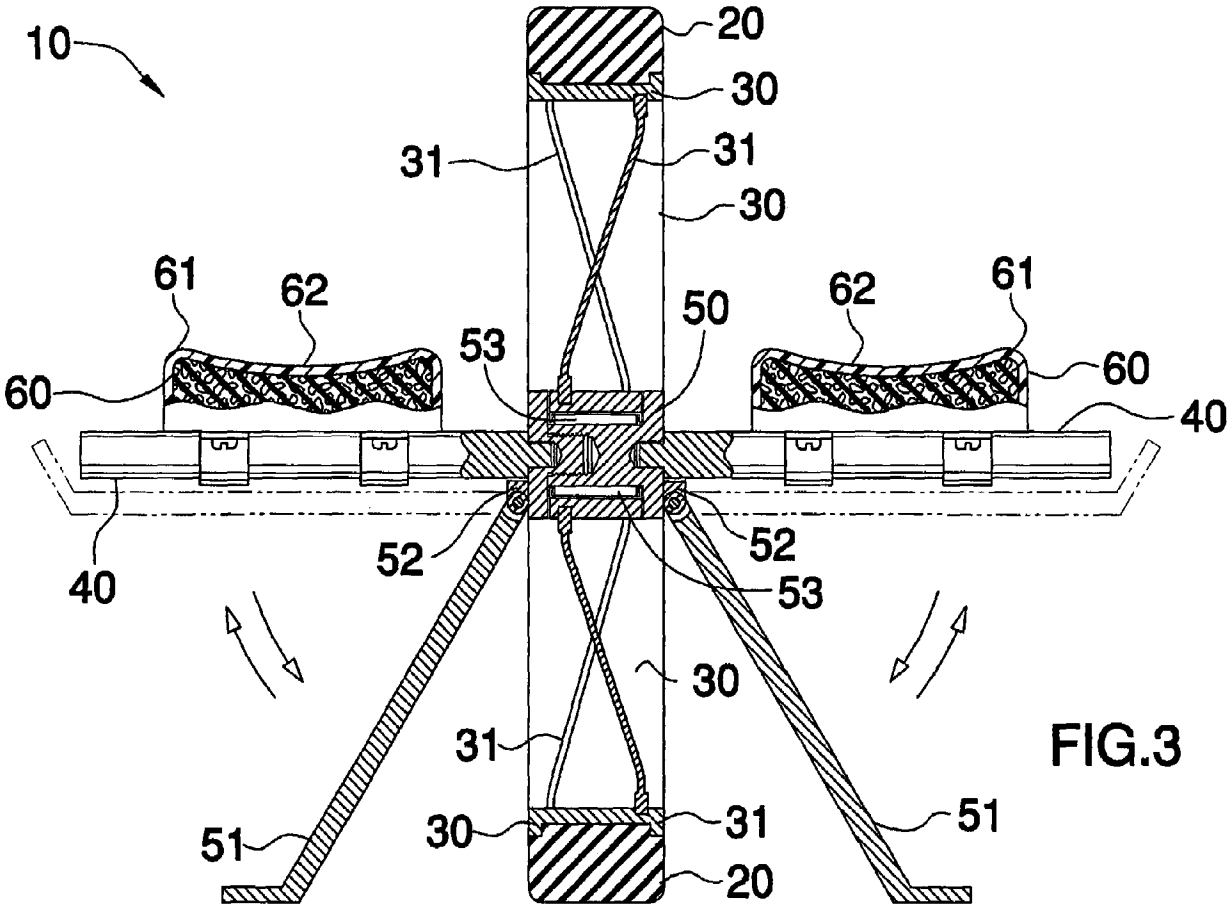
FIG. 3 is an enlarged cross-sectional view of the apparatus shown in FIG. 1, taken along line 8-8.
Figure 4:
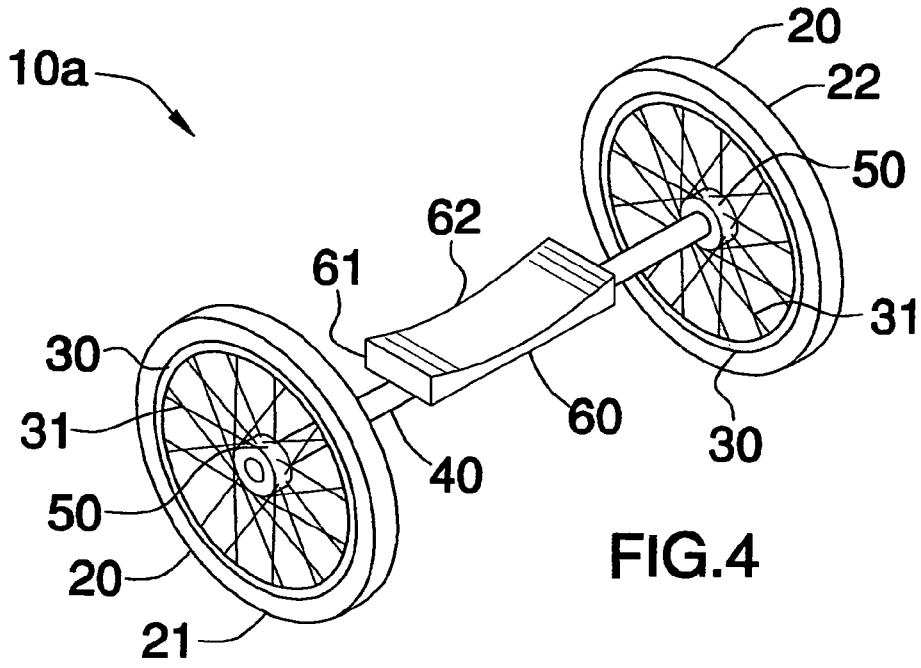
FIG. 4 is a perspective view showing an alternate embodiment of the present invention.
Figure 5:
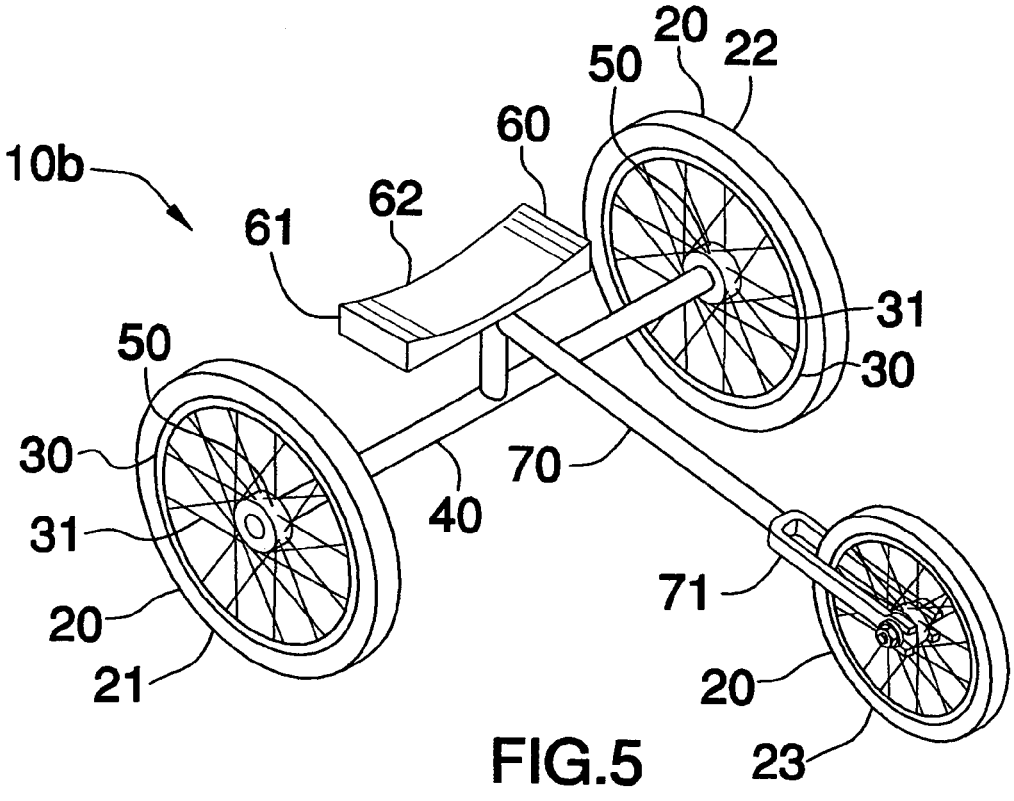
FIG. 5 is a perspective view showing yet another embodiment of the present invention.
Figure 6:
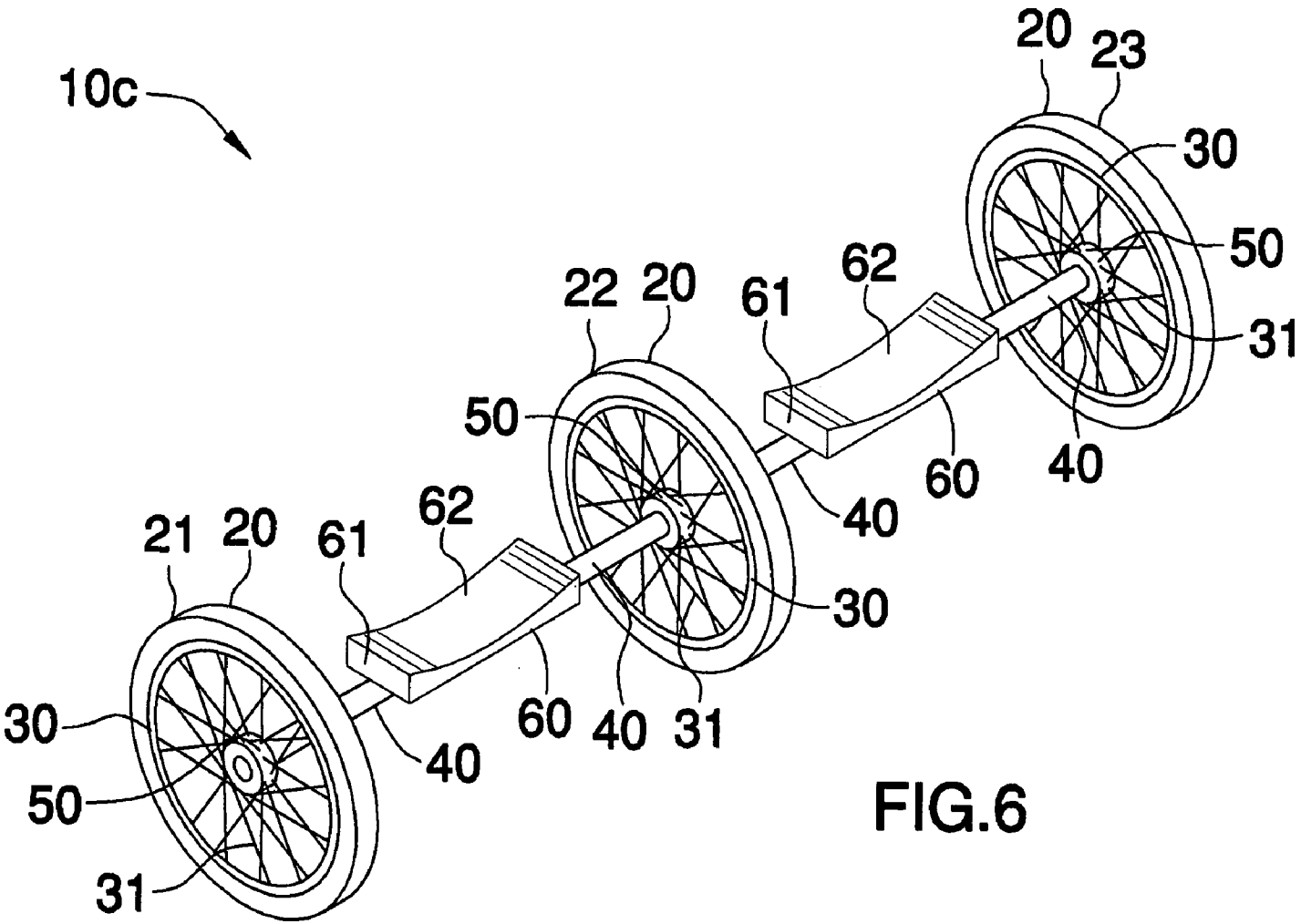
FIG. 6 is a perspective view showing yet another embodiment of the present invention.
Figure 7:
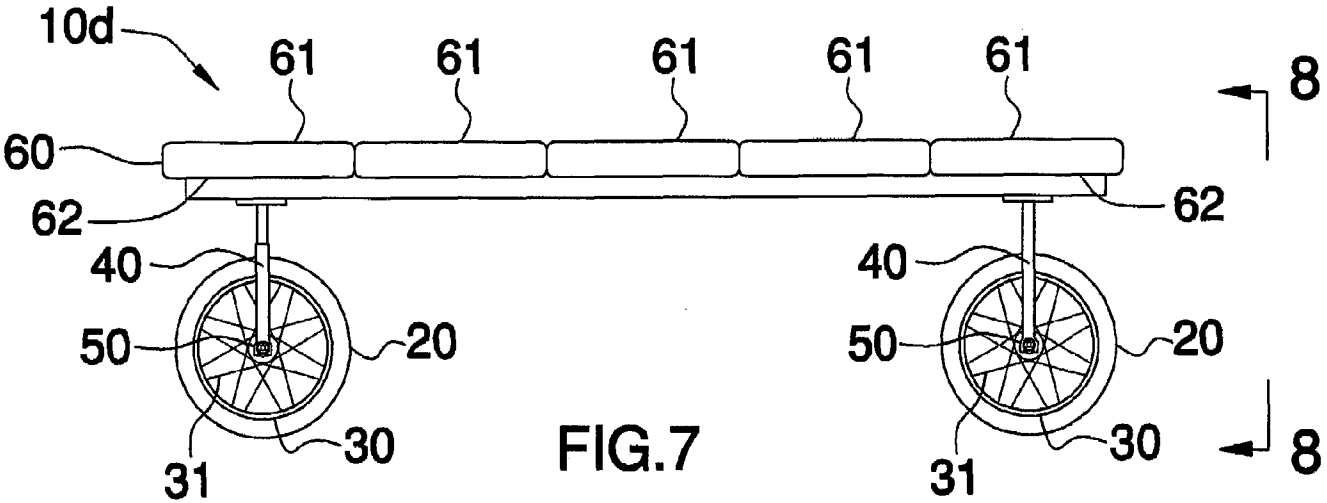
FIG. 7 is a perspective view showing yet another embodiment of the present invention.
Figure 8:
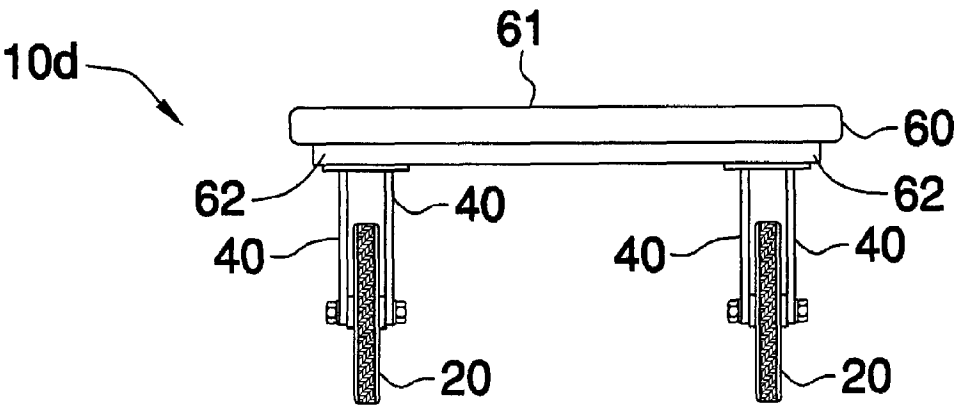
FIG. 8 is a front elevational view of the embodiment shown in FIG. 7.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures. Sub-notations refer to alternate embodiments of like elements.

The apparatus of this invention is referred to generally in FIGS. 1-8 by the reference numeral 10 and is intended to provide a torso exercising apparatus. It should be understood that the apparatus 10 may be used to exercise many different types of muscle groups and should not be limited to exercising only the torso muscles.

Referring initially to FIG. 1, the apparatus 10 includes at least one wheel assembly including at least one wheel 20 and at least one rim 30 that has a plurality of spokes 31 diametrically extending between a circumference thereof. The apparatus 10 further includes an elongated axle 40 secured to a substantially central portion of at least one rim 30, and at least one hub 50 including a bearing 53 disposed therein for cooperating with the at least one rim 30 so that at least one wheel assembly can be rotated along a select surface.

The present invention also includes a mechanism 60 for supporting a user's feet at an elevated position and along a substantially horizontal plane. The supporting mechanism 60 is secured to the axle 40 and is disposed adjacent to the at least one wheel assembly to thereby allow a user to effectively perform exercise movements while extended along a generally horizontal plane. In select embodiments, the plurality of pads 61 have a concave top surface 62 formed from resilient material for providing user comfort during exercising conditions. The concave shape of the plurality of pads 61 also prevents a user's feet from slipping off of the pads 61, thereby reducing the likelihood of personal injury to the user.

In a preferred embodiment, the apparatus 10 includes a plurality of elongated leg members 51 that have opposed end portions 52 pivotally connected to the hub 50 and engageable with a ground surface. The plurality of leg members 51 are movable between lowered and raised positions along a predetermined arcuate path for advantageously providing lateral support and assisting a user to maintain a substantially stable position during exercising conditions. In such an embodiment, the plurality of pads 61 are secured to the axle 40 at opposite sides of the at least one wheel assembly.

In an alternate embodiment 10*a*, first 21 and second 22 spaced wheel assembly are disposed adjacent opposed end portions of the axle 40 and a supporting mechanism 60 is positioned substantially medially of the first 21 and second 22 wheel assembly.

In yet another embodiment 10*b*, a third 23 wheel assembly is spaced forwardly from the first 21 and second 22 wheel assembly for providing additional support during operating conditions. Such an embodiment 10*b* further includes an elongated support member 70 having a forked end portion 71 secured to the third 23 wheel assembly for advantageously maintaining the supporting mechanism 60 spaced above the axle 40.

In yet another embodiment 10*c*, the first 21, second 22 and third 23 wheel assembly are equally spaced along a length of the axle 40. The supporting mechanism 60 includes a plurality of pads 61 juxtaposed between the first 21, second 22 and third 23 wheel assembly so that a user's feet can be disposed at opposed sides of the second 22 wheel assembly respectively.

In yet another embodiment 10*d*, the at least one wheel assembly is secured subjacent to opposed corners 62 of the supporting mechanism 60. Embodiment 10*d* provides added stability and can easily be employed by the elderly without the fear of injury. This allows a selected demographic portion of the population that needs exercise, but usually can not get it from conventional exercise equipment, to improve their health as well. The axle 40 extends upwardly from select ones of the at least one wheel assembly and is telescopically adjustable along a substantially vertical plane for effectively raising and lowering a height of the supporting mechanism 60 along an arcuate path, as desired by a user.

The appealing features of the apparatus 10 are its ability to strengthen the user's arms and upper body while also providing a good workout for their cardiovascular and respiratory systems. The apparatus 10 allows a fitness enthusiast to perform the wheelbarrow run, an procedure that usually requires two individuals, without any assistance. The apparatus 10 effectively supports the user's lower body, thus forcing them to use and develop the muscles of the upperbody.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A portable exercising apparatus for isolating a user's torso muscles, said apparatus comprising:

at least one wheel assembly comprising at least one rim;

at least one wheel disposed on the outer circumference of the rim;

at least one hub located at a substantially central portion of the rim;

a plurality of spokes extending radially from the hub to the rim;

a bearing disposed within the hub;

an elongated axle secured to the hub such that the wheel is disposed at substantially the middle portion of the axle to allow the wheel to be rotated along a support surface;

and a means for supporting a user's feet, on both sides of the wheel, at an elevated position relative to the support surface to allow a user to perform exercise movements while the user is extended horizontally along the support surface with the user's feet being supported on the support means wherein said axle is bifurcated into first and second coextensively shaped sections threadably and removably coupled to opposite faces of said hub, said first and second sections having inwardly extending flange portions monolithically formed with medial ends thereof and equidistantly penetrating into said opposite faces of said hub and remaining oppositely spaced on left and right regions of said hub, said hub also comprising a substantially T-shaped adaptor member threadably mated directly with said hub and protruding about midway through said hub, said adaptor member having a threaded finger seated medially of said first member and further having a threaded bore axially aligned with said threaded finger, said flange portion of said first section being threadably engaged with said bore of said adaptor member such that said first section is spaced laterally and away from said threaded finger of said adaptor member, said first and second sections remaining statically and rigidly maintained alone a horizontal plane.

2. The apparatus of claim 1, wherein said supporting means comprises:

a plurality of pads secured to said axle at opposite sides of said at least one wheel, said plurality of pads having a concave top surface and being formed from resilient material for providing user comfort during exercise.

3. The apparatus of claim 2, further comprising: a plurality of elongated leg members having opposed end portions pivotally connected to said hub and engageable with the support surface, said plurality of leg members being movable between lowered and raised positions along a predetermined arcuate path for providing lateral support for assisting a user to maintain a substantially stable position during exercise.

4. The apparatus of claim 1 further comprises a second wheel disposed at one end of the axle and a third wheel disposed at the other end of the axle such that the three wheels are equally spaced coaxially along the length of said axle and a support means that includes pads are disposed on the axle between the wheels such that the user's feet can be supported on both sides of the center wheel.

* * * * *